US006206689B1

(12) United States Patent
Doucet et al.

(10) Patent No.: US 6,206,689 B1
(45) Date of Patent: Mar. 27, 2001

(54) CHILD RESISTANT LIGHTER

(75) Inventors: Michel J. M. Doucet, Bain sur Ouste; Rene D. Frigiere, Allaire, both of (FR); Paul Adams, Monroe, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/382,593

(22) Filed: Aug. 25, 1999

Related U.S. Application Data

(63) Continuation-in-part of application No. 09/377,811, filed on Aug. 20, 1999, which is a continuation-in-part of application No. 09/172,609, filed on Oct. 15, 1998.

(51) Int. Cl.[7] ..... F23Q 2/28

(52) U.S. Cl. ..... 431/153; 431/255

(58) Field of Search ..... 431/153, 255

(56) References Cited

U.S. PATENT DOCUMENTS

| | | |
|---|---|---|
| 3,734,680 | 5/1973 | Maruyama . |
| 3,891,381 | 6/1975 | Moriya . |
| 3,898,031 | 8/1975 | Rusakowicz . |
| 4,457,697 | 7/1984 | Kitabayashi . |
| 4,758,152 | 7/1988 | Kordecki . |
| 4,784,601 | 11/1988 | Nitta . |
| 4,784,602 | 11/1988 | Nitta . |
| 4,786,248 | 11/1988 | Nitta . |
| 4,799,877 | 1/1989 | Bisbee . |
| 4,830,603 | 5/1989 | Cirami . |
| 4,832,596 | 5/1989 | Morris, Sr. . |
| 4,859,172 | 8/1989 | Nitta . |
| 4,904,180 | 2/1990 | Nitta . |
| 5,002,482 | 3/1991 | Fairbanks et al. . |
| 5,035,608 | 7/1991 | Parren . |
| 5,066,220 | 11/1991 | Vick . |
| 5,074,781 | 12/1991 | Fujita . |
| 5,090,893 | 2/1992 | Floriot . |
| 5,125,829 | 6/1992 | McDonough et al. . |
| 5,145,358 | 9/1992 | Shike et al. . |
| 5,165,885 | 11/1992 | Iwahori . |
| 5,165,886 | 11/1992 | Frigiere . |
| 5,186,618 | 2/1993 | Shike et al. . |
| 5,228,849 | 7/1993 | Frigiere . |
| 5,240,408 | 8/1993 | Kenjiro et al. . |

(List continued on next page.)

FOREIGN PATENT DOCUMENTS

WO 99/46539 9/1999 (WO) .

OTHER PUBLICATIONS

U.S. application Ser. No. 08/583,214, filed Jan. 4, 1996 entitled "Safety Lighter with Smooth Striker Wheel Edges" to Sher.

U.S. application Ser. No. 08/640,195, filed Jan. 4, 1995 entitled "Childproof Piezoelectric Lighter with Sliding Mechanism" to Sher.

www.polycity.com, "Child Resistant Lighters" S9 Push–down Safety Lock; downloaded Oct. 7, 1999.

copy of lighter sample.

Digital Photos of AIM Lighter (4 sheets), purchased in Aug. of 1999.

*Primary Examiner*—Ira S. Lazarus
*Assistant Examiner*—Sara Clarke
(74) *Attorney, Agent, or Firm*—Pennie & Edmonds LLP

(57) ABSTRACT

A child resistant lighter is disclosed which includes an actuator and a latch member pivotally coupled thereto. The latch member includes a finger actuation portion and a body portion extending therefrom. The body portion has a free end. When in an inoperative state, the free end of the latch member is aligned with a blocking surface of the lighter body, thus, preventing inadvertent lighting of the lighter. When in an operative state, the free end of the latch member is pivoted out of alignment with the blocking surface so that the lighter can function. During pivoting, as the finger actuation portion moves in a first direction, the free end moves in an opposite, second direction. The first and second direction are transverse.

34 Claims, 8 Drawing Sheets

U.S. PATENT DOCUMENTS

| | | |
|---|---|---|
| 5,262,697 | 11/1993 | Meury . |
| 5,288,226 | 2/1994 | Khemarangsan . |
| 5,295,819 | 3/1994 | Gómez López et al. . |
| 5,334,011 | 8/1994 | Frigiére . |
| 5,348,467 | 9/1994 | Piffath et al. . |
| 5,368,473 | 11/1994 | Kenjiro et al. . |
| 5,409,372 | 4/1995 | Nobuo . |
| 5,417,571 | 5/1995 | Kvalseth . |
| 5,431,558 | 7/1995 | McDonough et al. . |
| 5,435,719 | 7/1995 | McDonough et al. . |
| 5,445,518 | 8/1995 | McDonough et al. . |
| 5,456,598 | 10/1995 | McDonough et al. . |
| 5,458,482 | 10/1995 | Saito et al. . |
| 5,462,432 | 10/1995 | Kim . |
| 5,468,144 | 11/1995 | Iwahori . |
| 5,472,338 | 12/1995 | Ansquer . |
| 5,487,657 | 1/1996 | Fairbanks et al. . |
| 5,513,980 | 5/1996 | Rasmussen et al. . |
| 5,531,591 | 7/1996 | Yamazaki . |
| 5,538,417 | 7/1996 | Chan . |
| 5,558,514 | 9/1996 | Ansquer . |
| 5,584,682 | 12/1996 | McDonough et al. . |
| 5,636,979 | 6/1997 | McDonough et al. . |
| 5,642,993 | 7/1997 | McDonough et al. . |
| 5,655,901 | 8/1997 | Makoto . |
| 5,662,466 | 9/1997 | Cheng . |
| 5,697,775 | 12/1997 | Saito et al. . |
| 5,704,776 | 1/1998 | Sher . |
| 5,735,294 | 4/1998 | McDonough et al. . |
| 5,769,625 | 6/1998 | Sher . |
| 5,788,474 | 8/1998 | Chung et al. . |
| 5,788,476 | 8/1998 | Sher . |
| 5,829,963 | 11/1998 | Ichikawa . |
| 5,833,448 | 11/1998 | Doucet et al. . |
| 5,839,892 | 11/1998 | Hwang . |
| 5,885,069 | 3/1999 | Roglet . |
| 6,022,211 * | 2/2000 | Wang ..... 431/153 |

* cited by examiner

CHILD RESISTANT LIGHTER

This application is a continuation-in-part of co-pending U.S. patent application Ser. No. 09/377,811 filed Aug. 20, 1999, which in turn is a continuation-in-part of co-pending U.S. patent application Ser. No. 09/172,609 filed Oct. 15, 1998.

BACKGROUND OF THE INVENTION

1. Technical Field

The present invention relates to a lighter employing an ignition system which presents increased difficulty of operation by unintended users, and more particularly, relates to a piezoelectric lighter with such a system.

2. Background Art

Disposable gas lighters are available in a variety of forms. One common element of disposable lighters is an actuator pad or lever used to initiate the flow of fuel. An actuator pad is operated in conjunction with a spark producing mechanism so that the flow of fuel is ignited soon after it commences. For example, lighters employing conventional spark wheels require a user to rotate a toothed spark wheel against a flint in order to generate a spark. The user then depresses the actuator pad, to release gas and produce a flame.

Another means of ignition for disposable lighters employs a piezoelectric mechanism. In this type of ignition mechanism, a piezoelectric element, such as a crystal, is struck by a plexor in order to produce an electric spark. The spark is conducted to a location near the opening of the valve to ignite the gaseous fuel. The actuator pad, upon forced depression by a user, commences both the flow of the fuel and the ignition process. An example of such a piezoelectric ignition mechanism is disclosed in U.S. Pat. No. 5,262,697, entitled "Piezoelectric Mechanism For Gas Lighters."

As with spark wheel ignition mechanisms, measures have been introduced to increase the difficulty of activation to inhibit unintended activation of piezoelectric mechanisms or activation by unintended users (e.g., children younger than five years of age). One typical method is to incorporate a separate latch member disposed under the actuator pad, which inhibits depression of the actuator pad. Examples of such mechanisms are shown in U.S. Pat. Nos. 5,435,719, 5,584,682, and 5,636,979.

There remains, however, a need in the art for other mechanisms, which increase the difficulty of unintentional operation or operation by unintended users, and at the same time are user-friendly for intentional operation by intended users.

SUMMARY OF THE INVENTION

According to the present invention a lighter resistant to operation unintentionally or resistant to use by unintended users is disclosed. The lighter comprises a housing having a fuel compartment, a valve for supplying fuel from the fuel compartment, an actuator, an ignition mechanism, and a latch member. The actuator is mounted for movement with respect to the lighter body. The ignition mechanism is coupled to the actuator and the actuator is movable from a first position to an actuation position along a longitudinal, actuation axis. This movement of the actuator causes the release of fuel and causes the ignition mechanism to ignite the fuel. The latch member is pivotally coupled to the actuator. The latch member includes a finger actuation portion and a body portion with a free end.

When the latch member is in an inoperative state or position, the free end of the body portion of the latch member is aligned with a blocking surface of the housing to limit movement of the actuator along the actuation axis. Moving the finger actuation portion in a first direction causes the free end of the body portion to move in a second direction opposite the first direction. This movement of the finger portion also causes the free end to become unaligned with the blocking surface of the housing. In this operative, state or position, movement of the actuator from the first position to release fuel and the actuation position to actuate the ignition mechanism to ignite the fuel is permitted.

In one embodiment, the first direction and the second direction are transverse or sideways.

In yet another embodiment, The actuator further defines a longitudinally extending channel, and the latch member is received by the channel.

According to another embodiment of the present invention, the latch member has cam surfaces for pivotally coupling the latch member to the actuator. In another embodiment, the body portion of the latch member further includes a central member and resilient arms that extend upward from the central member. In yet another embodiment, a biasing element is disposed between the resilient arms and the central member for biasing the latch member into the inoperative position.

BRIEF DESCRIPTION OF THE DRAWINGS

To facilitate the understanding of the characteristics of the invention, the following drawings have been provided wherein.

DESCRIPTION OF THE PREFERRED EMBODIMENTS

Figure 1:
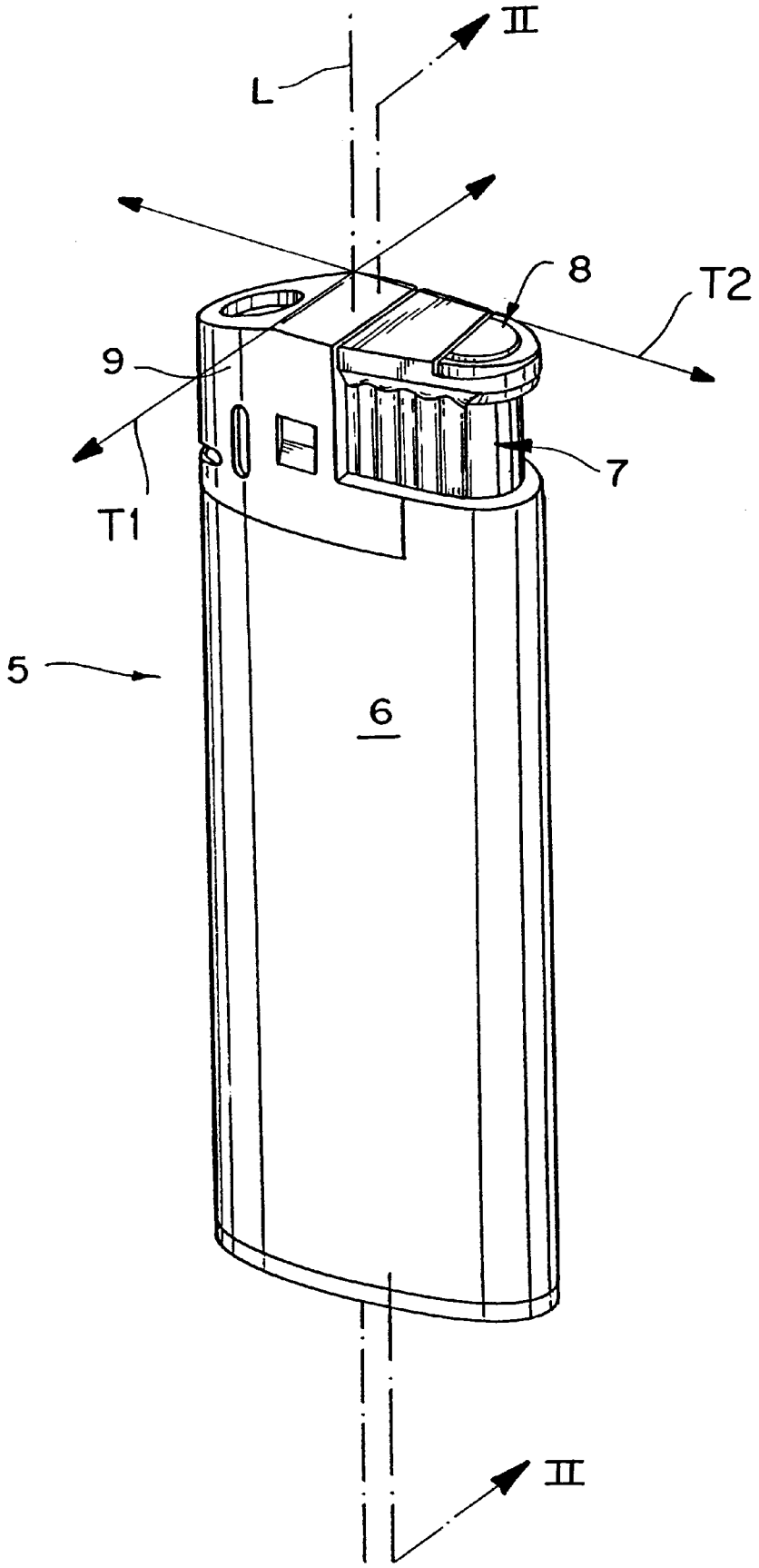
FIG. 1 is a perspective view of a lighter having an actuator and a latch member formed in accordance with the present invention.

Referring to the drawings, wherein like reference numbers are used to designate like parts, and as shown in FIG. 1, a lighter 5 having an actuation inhibiting mechanism formed in accordance with the principles of the present invention is shown. For reference, the lighter 5 has a longitudinal or actuation axis L, a first transverse axis T1 perpendicular to axis L, a second transverse axis T2 that is perpendicular to both the longitudinal axis L and the first transverse axis T1. The lighter 5 further includes a housing or body portion 6, a selectively depressible actuator 7, a latch member 8, and a wind shield 9. Additionally, a piezoelectric ignition mechanism 10 is provided within lighter 5, as shown in FIG. 2.

Figure 2:
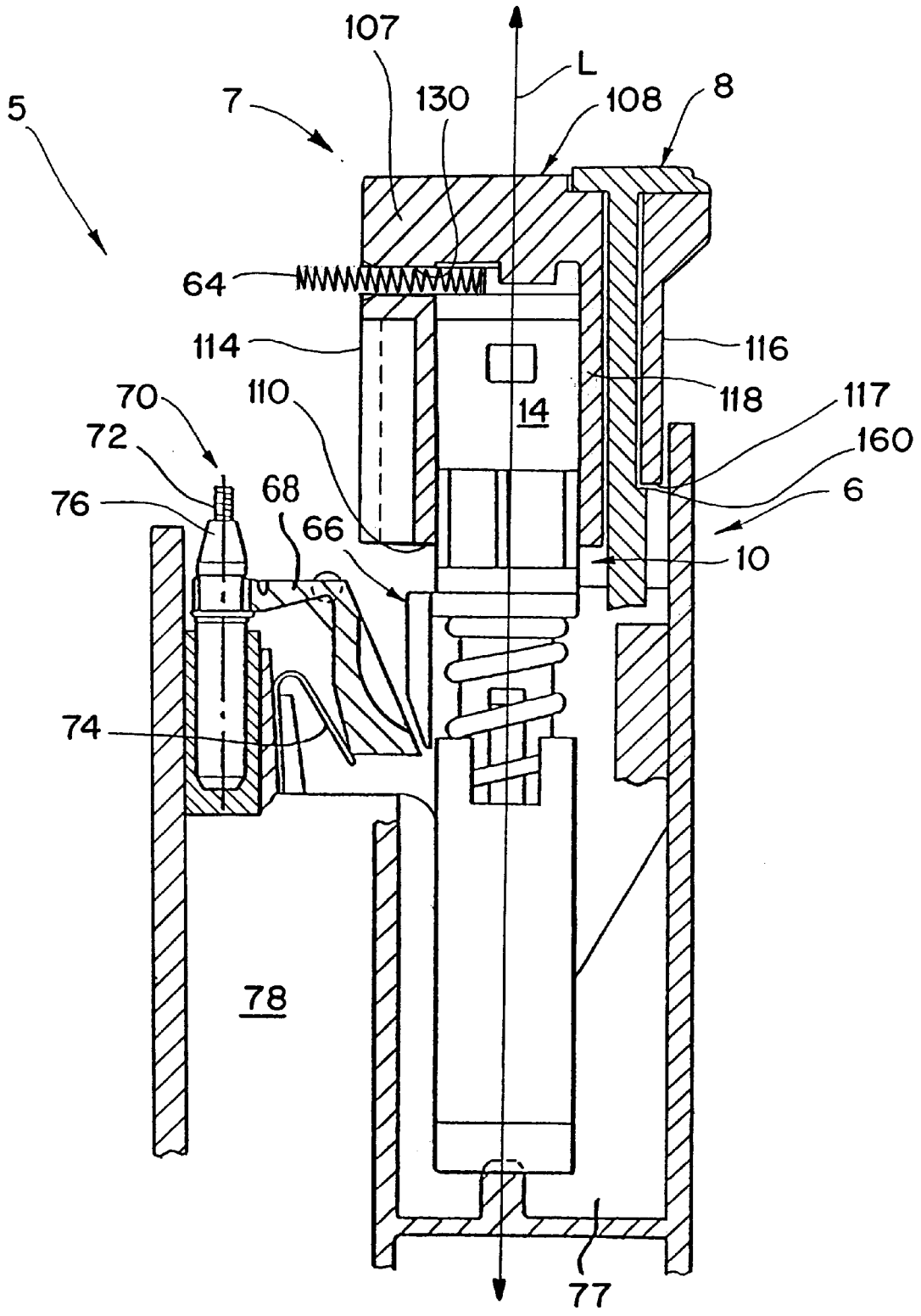
FIG. 2 is an enlarged, front longitudinal view, in partial cross-section, along line II—II, of the lighter of FIG. 1 showing the actuator and latch member in an inoperative state.

Referring now to FIG. 2, the ignition system of lighter 5 includes a piezoelectric ignition mechanism 10, which is represented schematically. The present invention is not limited to a particular type of ignition mechanism and various types of piezoelectric mechanisms and nonpiezoelectric mechanisms can be used. One suitable piezoelectric ignition mechanism 10 for lighter 5 is disclosed in U.S. Pat. No. 5,262,697, entitled "Piezoelectric Mechanism For Gas Lighters" which is expressly incorporated by reference herein in its entirety. Another suitable type of ignition mechanism includes a spark-wheel and flint. An example of a spark-wheel and flint ignition mechanism that can be used with the present invention is disclosed in U.S. Pat. No. 5,468,144 issued to Iwahori.

Piezoelectric mechanism 10 is one element in an electrical circuit that includes, among other components, first electrode 64, cam member 66, valve actuator 68, valve system 70 and second electrode 72. After the piezoelectric mechanism 10 is compressed, as known by those of ordinary skill in the art, an electrical potential difference is created that is conducted through this circuit, and creates substantially the same potential difference between first electrode 64 and second electrode 72. This potential difference is sufficient to discharge a spark across the air gap between the two electrodes. In other words, the two electrodes act similar to a capacitor with an air dielectric disposed there between. Any electrically conductive material may be utilized to make the components of this circuit. A person of ordinary skill in the art may select suitable materials for the various components in this circuit.

Referring to FIG. 2, when the actuator 7 is depressed, as discussed below, to create the spark, cam member 66 is also depressed, and acts on valve actuator 68. Valve actuator 68 is pivoted such that when cam member 66 pushes one end of valve actuator 68 downward, the other end is moved upward thereby lifting valve system 70 to release fuel gas. The released gas is then ignited by the spark discharged between electrodes 64 and 72.

Valve system 70 controls the release of fuel from the fuel supply (not shown). In a preferred embodiment, as shown generally in FIG. 2, the fuel supply is compressed hydrocarbon gas and valve system 70 normally has an open valve that is forced closed by the pressure of a spring member 74. In this embodiment, valve actuator 68 acts on valve system 70 to lift valve stem 76 upward to release the compressed hydrocarbon.

Figure 3:
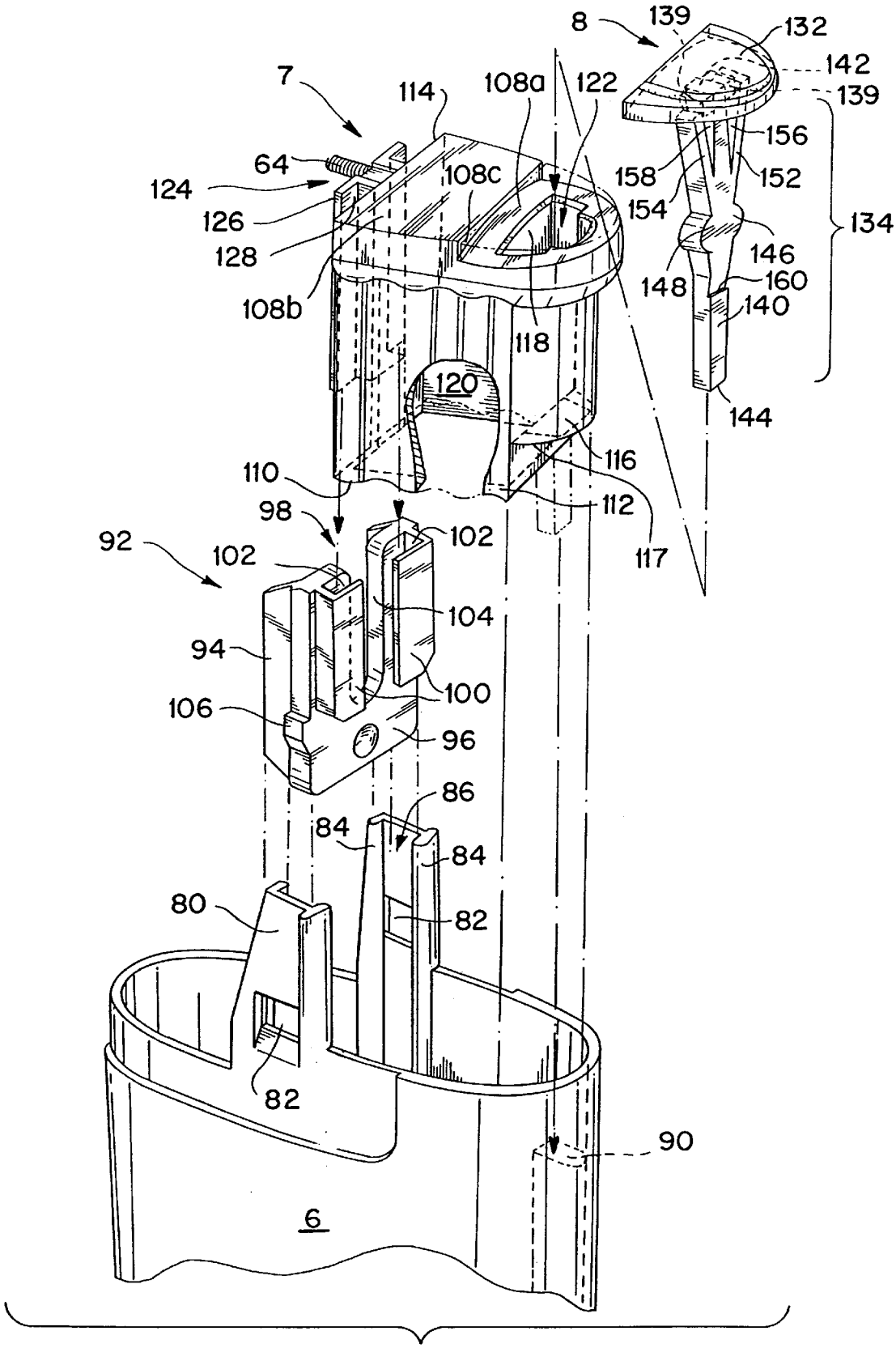
FIG. 3 is an enlarged, exploded, rear, perspective view of the lighter of FIG. 1 showing a portion of the housing, a guide, an actuator with an electrode, and a latch member.

Referring to FIGS. 2 and 3, the housing 6 further includes a first chamber 77 that receives the piezoelectric ignition mechanism 10, a second chamber 78 (partially shown) that contains a fuel supply (not shown), and two support members 80. The support members 80 extend vertically from the upper end of the housing. There is one support member 80 on either side of the housing. Each support member 80 defines an opening 82 there through. The inner surface of each support member 80 has two transversely and longitudinally extending ribs 84. The ribs 84 are spaced apart to define a longitudinally extending groove 86. The housing 6 further includes a rib or blocking surface 90 (shown in phantom), which extends inwardly from the housing back wall.

Referring to FIG. 3, the lighter further includes a guide 92. The housing, actuator, guide, and latch member are preferably made with plastic material, however other materials can be used. The guide 92 includes two spaced, parallel side walls 94 that are joined together by a central wall 96. A space 98 is defined between the front ends of the side walls 94. The rear ends of each of the side walls include a transversely extending wall portion 100 that defines a longitudinally extending slot 102. The central wall 96 of the guide defines a slot 104. The outer surface of each of the side walls 94 includes an outwardly extending projection 106. The projections 106 are sized to fit within the housing openings 82.

When the lighter is assembled, the guide 92 is disposed between the support members 80, and the support members 80 flex outward to accommodate the guide 92. Once the projections 106 are aligned with the openings 82, the support members 80 return to their vertical, initial position. The interaction between the projections 106 and the openings 82 allow the guide 92 to be retained within the housing.

Referring to FIGS. 2 and 3, the actuator 7 comprises a top wall 107 with a top surface 108, a spaced lower surface 110, spaced side walls 112, front wall 114 and rear wall 116. The inner surfaces of the side walls 112 are parallel to one another. Rear wall 116 has an intermediate surface 117. The walls 112, 114 and 116 join the top wall 107 and the lower surface 110. The housing further includes an inner wall 118 extending between the side walls 112. The walls 107, 112, 114, and 118 define a forward chamber 120 for receiving the piezoelectric mechanism 10. The walls 107, 112, 116, and 118 define a rear chamber 122 for receiving the latch member 8.

The top surface 108 includes a lower surface portion **108*a* and an elevated, upper surface portion 108*b* separated by a ledge member 108*c*. As best seen in FIG. 3, the lower surface portion 108*a*** is preferably curved.

The front wall 114 further includes a T-shaped projection 124. The projection 124 includes transversely extending walls 126 spaced from the front wall 114 to define slots 128. The projection 124 is configured so that the walls 126 fit within the slots 102, and the wall portions 100 fit within the slots 128 and allow the actuator 7 to slide along the longitudinal axis L with respect to the guide 92.

Referring to FIG. 2, the actuator 7 defines a bore 130 for receiving the first electrode 64. The electrode 64 extends through the bore 130 and contacts the piezoelectric mechanism 10. Referring to FIG. 3, when the actuator 7 is slidably connected to the guide 92, the electrode 64 is disposed within the slot 104.

Figure 4:
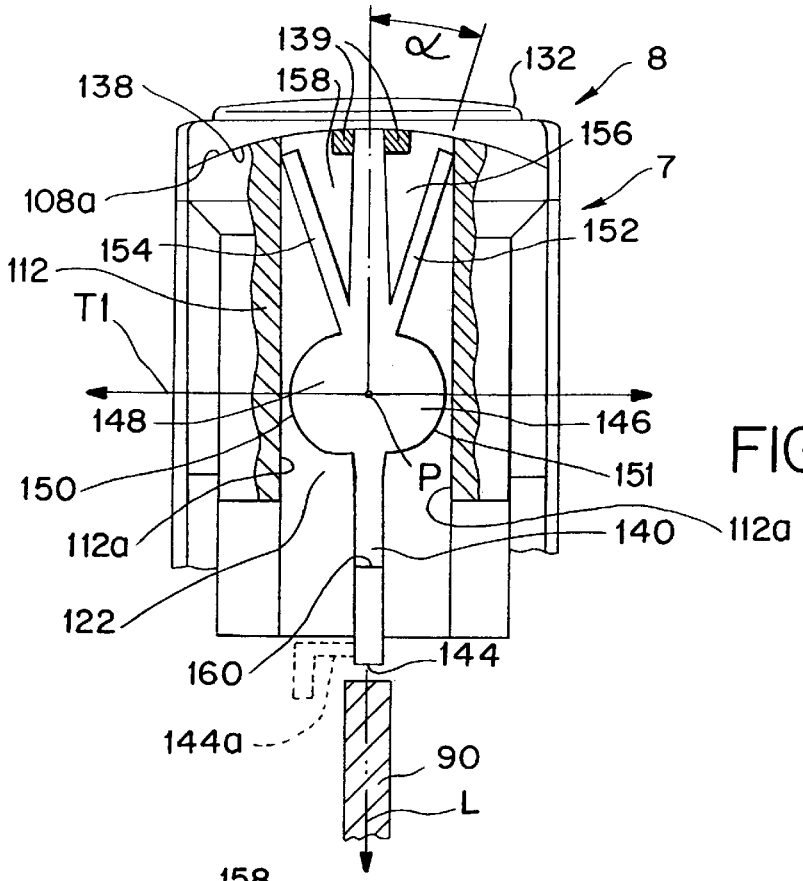
FIG. 4 is an enlarged, rear view of the actuator, latch member, and housing having portions broken away for clarity, wherein the latch member is in a locked position or inoperative state.

Referring to FIGS. 3 and 4, the latch member 8 comprises a finger actuation portion 132 and a body portion 134 downwardly extending from the finger actuation portion 132. When the body portion 134 of the latch member is disposed within the rear chamber 122 of the actuator 7, the finger actuation portion 132 covers a majority of the lower surface portion **108*a* of the actuator 7. The finger actuation portion 132 includes a lower surface 138 that is curved to match the curve of the lower surface portion 108*a*. The lower surface 138 of the finger actuation portion further includes two optional stops 139 on both sides of the body portion 134. In another embodiment, the latch member can include only one stop 139** disposed on either side of the body portion.

The body portion 134 includes a central member 140. The first end 142 (shown in phantom in FIG. 3) of the central member is connected to the lower surface 138 of the finger actuation portion 132. The second, free end 144 of the central member is spaced from the first end 142. The term "free end" means a surface of the latch member that contacts the blocking surface 90 (as shown in FIG. 3) in the inoperative position to prevent actuation. In another embodiment, as shown in FIG. 4, the latch member can include a projection with a free end 144*a* (shown in phantom) that extends from the side of the side of central member 140 of the latch member. In the inoperative position, the free end 144*a* also contacts the blocking surface 90 to prevent actuation. In this embodiment, a L-shaped projection 144*a* (shown in phantom) includes a free end. Interaction between the projection 144*a* and the blocking surface 90 allows the latch member to only actuate in one direction. In another embodiment, the L-shaped projection can be on the other side of the central member or it can have another shape.

The central member 140 further includes two pivot members 146 and 148 that extend transversely from the sides of the central member 140. The pivot member 148 includes a cam surface 150 and the pivot member 146 includes a cam surface 151. The surfaces 150 and 151 cooperate with the inner surfaces 112*a* of the side walls 112 defining the rear chamber 122. The cam surfaces and pivot members allow the latch member 8 to substantially pivot with respect to the actuator 7 in the first transverse direction T1. In another embodiment, only one of the pivot members 146 and 148 may have a cam surface that cooperates with the inner surface of the adjacent side wall 112.

The central member 140 further includes two, molded in, resilient arms 152 and 154 that extend from opposite, side surfaces of the central member. The arms 152 and 154 extend upwardly at an angle $\alpha$ from the central member 140. It is recommended that the angle $\alpha$ is greater than 0° and less than 90°, and preferably about 25°. In another embodiment, the arms could extend downwardly from the central member. The arms 152 and 154 are disposed between the pivot members 146 and 148 and the finger actuation portion 132. The arm 152 defines a space 156 between the central member 140 and the arm 152. The arm 154 defines a space 158 between the central member 140 and the arm 154.

In another embodiment, instead of the integral resilient arms the latch member can further include a separate metal leaf spring that is coupled, i.e., inserted, into a plastic, central member 140. The metal leaf spring is V-shaped so that it has resilient arms on either side of the central member that function similarly to the resilient arms to bias the latch member toward the inoperative position.

The central portion 140 also includes an outwardly extending ledge 160 that cooperates with the rear wall 116 (as shown in FIG. 2) of the actuator. Thus, preventing the easy removal of the latch member 8 from the actuator.

Referring to FIG. 4, when the latch member 8 is in an inoperative state or locked position, the free end 144 of the latch member 8 is aligned with the blocking surface 90. Thus, depression of the latch member 8 and the actuator 7 along the actuation axis L is arrested, and inadvertent lighting of the lighter is prevented.

Figure 5:
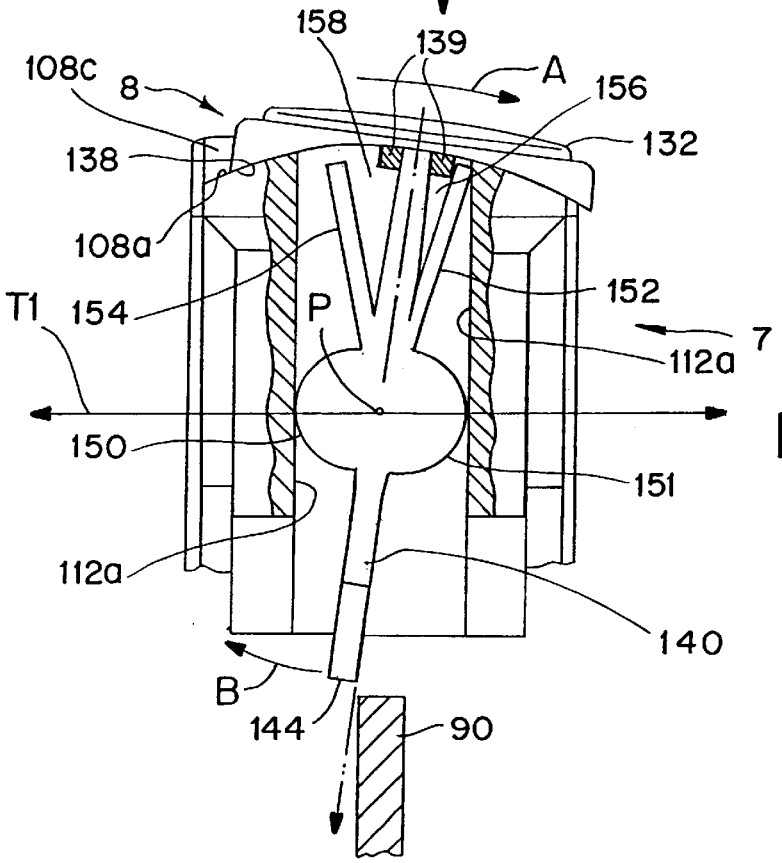
FIG. 5 is an enlarged, rear view of the actuator, latch member, and housing having portions broken away for clarity, wherein the latch member is in an unlocked position or operative state.

Referring to FIG. 5, in order to ignite the lighter, the latch member 8 is moved to an operative position. A user moves the finger actuation portion 132 of the latch member 8 sideways along the first transverse direction T1, as illustrated by the arrow A. This movement is facilitated by the curved lower surface 138 of the finger actuation portion 132 that slides along the curved, top surface portion 108*a* of the actuator 7. This causes the cam surfaces 150 and 151 to cooperate with the side walls 112*a*, and the latch member 8 substantially pivots about the axis P, which is parallel to the axis T2 (as shown in FIG. 1). Interaction between the actuator surrounding the channel 122 and the latch member prevents over-pivoting of the latch member. In addition, the arm 152 contacting stop 139 prevents over-pivoting of the latch member.

As the latch member 8 pivots, the arm 152 is supported by the wall 112*a*, and compressed against the wall. Also, the free end 144 of the latch member 8 moves in the direction of the arrow B opposite the direction of arrow A, and out of alignment with the blocking surface 90. As a result, the lighter is in an unlocked or operative position.

Referring to FIG. 2, in the operative position, a user may depress the latch member 8 causing the latch member 8 and actuator 7 to move downwardly along the actuation axis L. This movement releases fuel gas and compresses the piezoelectric mechanism 10, thereby causing ignition and actuation of the lighter.

Referring to FIG. 5, after releasing the latch member 7 and actuator 8, a spring (not shown) within the piezoelectric raises the actuator. The arm 152 biases the free end 144 of the latch member 8 back into alignment with the blocking surface 90 so that the lighter is again in the inoperative state (as seen in FIG. 2).

Depending, typically, on whether the user is right-handed or left-handed, the user will prefer to move the finger actuation portion in one direction or another. The symmetrical configuration of the latch member allows the finger actuation portion to be pivoted left or right so that one lighter is easily unlocked by users with either preference. The latch member has pivot members and resilient arms on either side so that the latch member functions when pivoted in either direction. However, the latch member of the present invention can be formed with one pivot member and one arm on either side of the central member so that the finger actuation portion can only be moved in one direction, depending on where the pivot member and arm are located.

Figure 6:
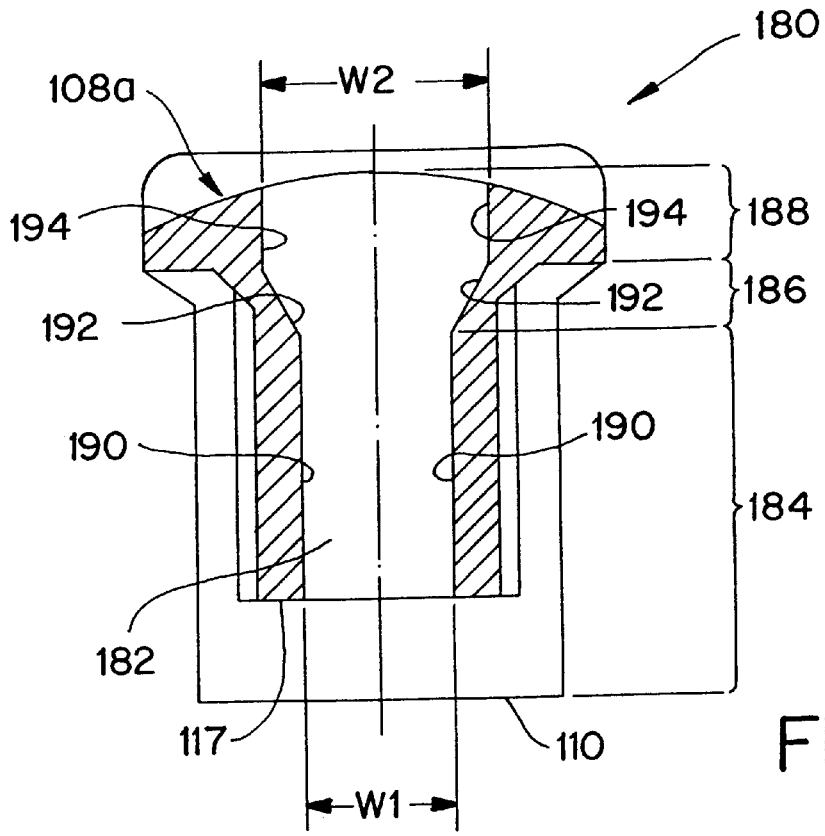
FIG. 6 is an enlarged, partial cross-sectional view of a preferred embodiment of the actuator for use with the lighter of FIG. 1.
Figure 7:
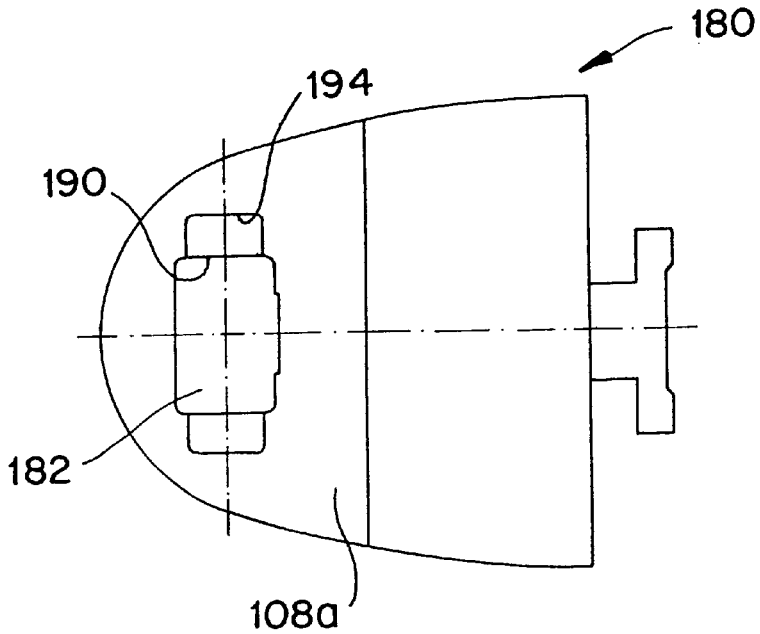
FIG. 7 is an enlarged, top view of the actuator shown in FIG. 6.

Referring to FIGS. 6 and 7, another embodiment of the actuator 180 is illustrated. The actuator 180 is similar to that discussed above. However, the actuator 180 has a rear chamber 182 with sections extending from the intermediate surface 117 of the rear wall to the top surface portion 108*a*. The chamber 182 includes a lower section 184, an intermediate section 186 and an upper section 188. The lower section 184 has spaced, parallel, inner surfaces 190 with a width W1 there between. The intermediate section 186 has spaced, angled, inner surfaces 192 that diverge from one another. The upper section 188 has spaced, parallel inner surfaces 194 with a width W2. The intermediate section 186 increases in width between W1 from W2. When the latch 8 (as shown in FIG. 4) is disposed within the rear chamber 182, the arms 152 and 154 contact the side walls 194. Also, when the latch member 8 is disposed within the rear chamber 182 of the actuator 180, the pivot members 146 and 148 cooperate with the inner surfaces 190 to allow the latch member to pivot similarly to that discussed above so that the latch moves between inoperative and operative positions.

Figure 8:
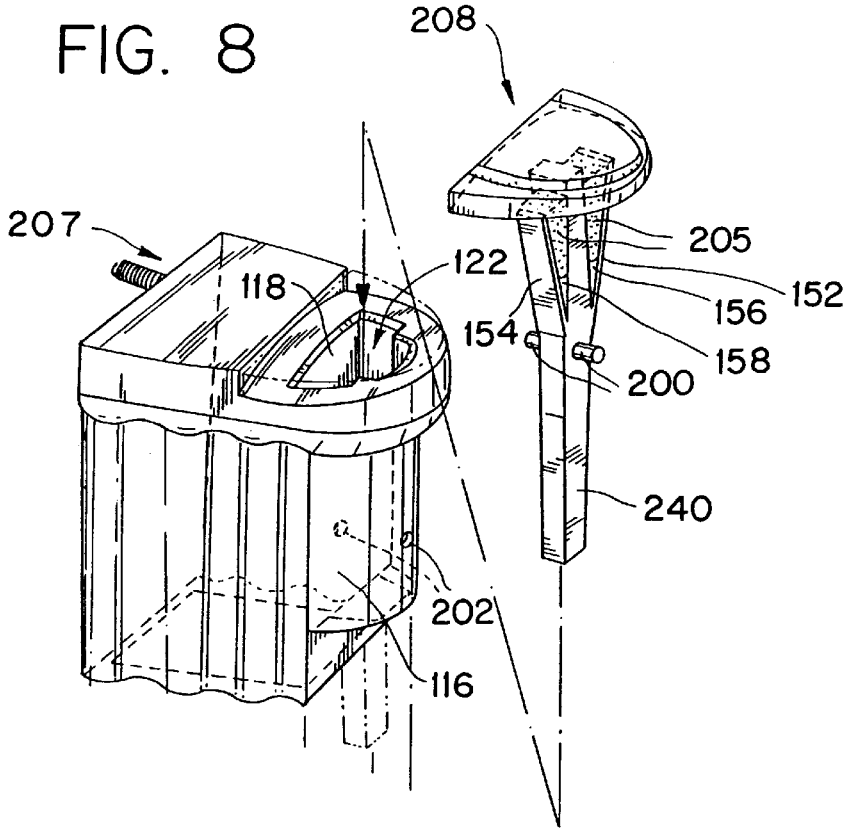
FIGS. 8–12 are enlarged, exploded, rear, perspective views of alternative embodiments of the actuator and the latch member for use with the lighter of FIG. 1.

Referring to FIG. 8, another embodiment of the actuator 207 and latch member 208 are illustrated. The actuator 207 and latch member 208 are similar to those discussed above. However, the latch member 208 has a central member 240 that includes pins 200 extending from the front and rear surfaces thereof. The actuator 207 has bores 202 defined in the inner wall 118 and the rear wall 116 for receiving the pins 200. When the latch member 208 is disposed within the rear chamber 122 of the actuator 207, the pins 200 and bores 202 cooperate to allow the latch member to pivot similarly to that discussed above so that the latch moves between locked and unlocked positions. In one embodiment, the pins 200 can be metal and inserted into a plastic, central member 240. In another embodiment, instead of holes the actuator can include shelves for pivotally supporting the pins. The shelves would extend from the inner and rear walls of the actuator into the rear chamber 122 so that the shelves are perpendicular to the inner and rear walls. The pins would be supported on the shelves and be able to pivot thereon.

The actuator 207 and the housing 6 (as shown in FIG. 3) are configured so that the actuator 207 slides along the longitudinal axis L within the chamber 20 without the guide 92 of the previous embodiment.

Furthermore, the latch member 208 includes two resilient wedges 205. The resilient wedges 205 are disposed within the spaces 156 and 158 between arms 152, 154 and central member 140. The resilient wedges 205 are additional biasing elements that bias the arms 152 and 154 away from the central member 240. When to latch member 208 is moved to the unlocked position, the wedges 205 bias the affected arm against the walls 112*a* of the actuator to return the latch member 208 to the locked position. Use of the additional biasing elements 205 allows more biasing force to be generated so that, for example, the arms can be thinner.

In this embodiment, the wedges are formed of a commercially available foam, which exhibits the necessary resiliency. However, other, additional biasing elements or no additional biasing elements can be used with this embodiment or other embodiments disclosed herein. Other types of biasing elements can be used with the latch member. For example, metal coil springs, leaf springs or the like can also be used.

Figure 9:
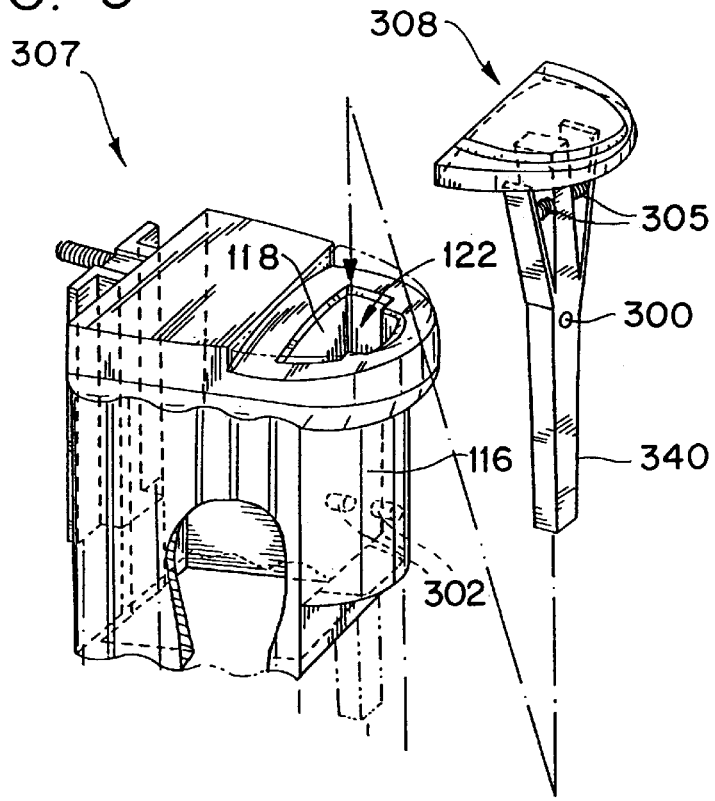

Referring to FIG. 9, another embodiment of the actuator 307 and the latch member 308 are illustrated. The actuator 307 and latch member 308 are similar to those discussed above in FIG. 8. However, the latch member 308 has a central member 340 that defines bores 300 in the front and rear surfaces thereof. The actuator 307 has pins 302 extending from the inner wall 118 and the rear wall 116. When the latch member 308 is disposed within the rear chamber 122 of the actuator 307, the pins 300 and bores 302 cooperate to allow the latch member to pivot, so that the latch moves between locked and unlocked positions. In another embodiment, the pins 300 could be replaced with transversely extending shelves that project perpendicularly from the central member 340. When the actuator with the shelves is disposed within the rear chamber 122, the shelves cooperate with the pins 302 to pivotally connect the latch member to the actuator. In this embodiment, the resilient wedges have been replaced with metal coil springs 305.

Figure 10:
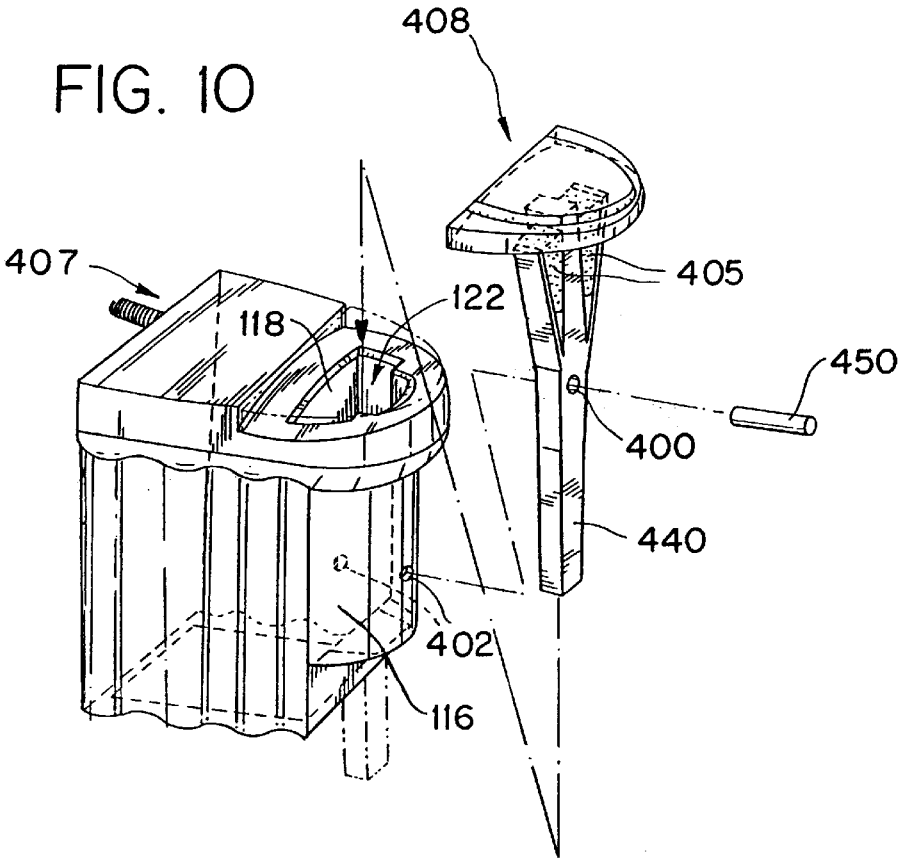

Referring to FIG. 10, another embodiment of the actuator 407 and the latch member 408 are illustrated. The actuator 407, latch member 408, and resilient wedges 405 are similar to those discussed above in FIG. 8. However, the latch member 408 has a central member 440 that defines a bore 400 through the latch member. The actuator 407 defines bores 402 in the inner wall 118 and the rear wall 116. When the latch member 408 is disposed within the rear chamber 122 of the actuator 407, the bore 400 and bores 402 are aligned. A separate pin 450 is disposed through the bores 400 and 402 to allow the latch member to pivot, so that the latch moves between inoperative and operative states.

Figure 11:
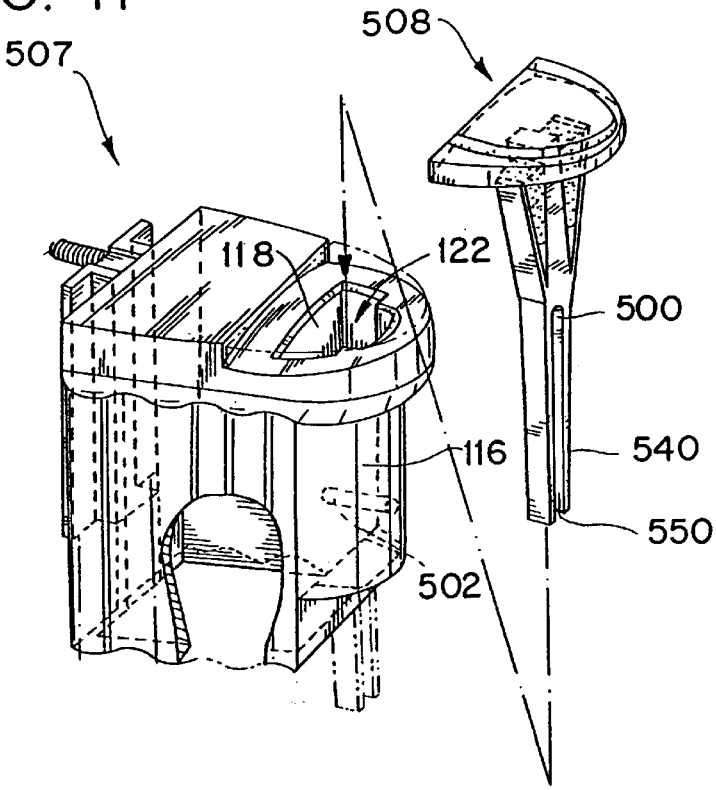

Referring to FIG. 11, another embodiment of the actuator 507 and the latch member 508 are illustrated. The actuator 507 and latch member 508 are similar to those discussed above in FIG. 8. However, the latch member 508 has a central member 540 that defines a notch 500 extending partially along the length of the member 540 from free end 550. The actuator 507 has a pin 502 extending from the inner wall 118 to the rear wall 116. When the latch member 508 is disposed within the rear chamber 122 of the actuator 507, the notch 500 and pin 502 cooperate to allow the latch member to pivot, so that the latch moves between inoperative and operative states.

Figure 12:
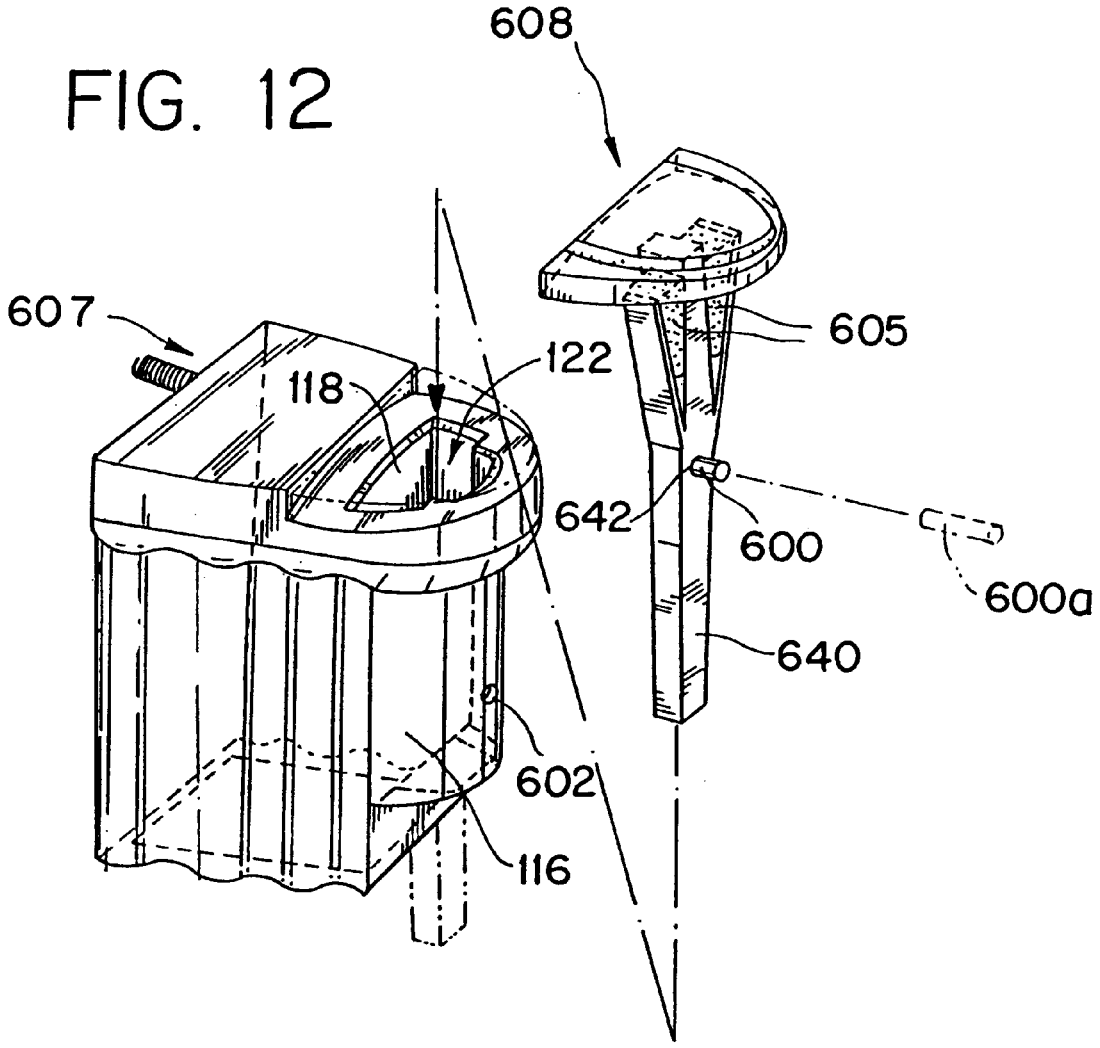

Referring to FIG. 12, another embodiment of the actuator 607 and the latch member 608 are illustrated. The actuator 607 and latch member 608 are similar to those discussed above in FIG. 8. The latch member 608 includes resilient wedges 605, similar to the wedges 205, discussed above. However, the latch member 608 has a central member 640 that defines a bore 642 partially therethrough having a pin 600 disposed therein. The pin 600 is coupled to the latch member and projects from the rear surface of the central member 640. The actuator 607 defines a bore 602 in the rear wall 116. When the latch member 608 is disposed within the rear chamber 122 of the actuator 607, the pin 600 is disposed within the bore 602, so that the latch moves between inoperative and operative states. In another embodiment, the pin 600*a* (as shown in phantom) can be separate from the latch member 608 and actuator to facilitate assembly. Once the latch member 608 is disposed in the channel 122, the latch member bore 642 and the bore 602 are aligned and the pin 600*a* is inserted therein to pivotally couple the latch and the actuator.

While it is apparent that the invention herein disclosed is well calculated to fulfill the objects above stated, it will be appreciated that modifications and embodiments may be devised by those skilled in the art. Although the pins and bores for pivotally coupling the actuator and latch member are shown as round, they are not limited to this shape and other shapes such as elliptical, hexagonal, and polygonal can be used. Other pivotal connections can be used to pivotally couple the actuator and latch member. The embodiments above can be modified so that some features of one embodiment are used with the features of another embodiment. It is intended that the appended claims cover all such modifications and embodiments as fall within the true spirit and scope of the present invention.

What is claimed is:

1. A lighter comprising:

a housing having a fuel supply and a blocking surface;

a valve for supplying fuel from said fuel supply;

an actuator mounted for movement with respect to said housing;

an ignition mechanism for igniting the fuel; and a latch member having a first portion and a second portion having a free end, wherein said latch member is pivotally coupled to said actuator, such that in a locked position the free end of the latch member is aligned with the blocking surface, wherein movement of the first portion in a first direction causes the free end to move in a second direction opposite to the first direction and causes the free end to become unaligned with the blocking surface which permits movement of said actuator from a first position to an actuation position, and the latch member is pivotal side-to-side.

2. The lighter of claim 1, wherein the ignition mechanism is movable from a first position to a second position along a longitudinal axis, and the first portion is a finger actuation portion and the second portion is a body portion, and the finger actuation portion being disposed on an upper surface of the actuator and the body portion extending downward from the finger actuation portion, the latch member including a transverse axis extending perpendicular to the longitudinal axis and the transverse axis extends from the front of the lighter body to the rear of the lighter body and the latch member is pivotal about the transverse axis.

3. The lighter as in claim 2, wherein the actuator further including walls defining a channel, and said body portion further including a central member extending from the finger actuation portion, and the central member including at least one pivot member extending from a side surface of said central member, the pivot member having a cam surface pivotally coupling with the walls of the channel.

4. The lighter as in claim 3, further including two pivot members extending from opposite side surfaces of said central member, each pivot member having a cam surface pivotally coupling with the walls of the channel.

5. The lighter as in claim 3, further including two resilient arms extending from the opposite side surfaces of the central member.

6. The lighter as in claim 5, wherein the resilient arms being molded integrally with the central member.

7. The lighter as in claim 5, wherein the resilient arms being formed from a metal leaf spring coupled to the central member.

8. The lighter as in claim 5, wherein the resilient arms extend from the central member at an angle of greater than 0° and less than about 90°.

9. The lighter as in claim 5, wherein the resilient arms extend from the central member at an angle of about 25°.

10. The lighter as in claim 5, further including a biasing element disposed between said resilient arms and the central member for biasing said latch member into said inoperative position.

11. The lighter as in claim 10, wherein said biasing element is formed of a foam.

12. The lighter as in claim 10, wherein said biasing element is a coil spring.

13. The lighter as in claim 10, wherein said biasing element is a leaf spring.

14. The lighter as in claim 2, wherein said upper surface of the actuator being curved, and the finger actuation portion having a lower surface curved to match the upper surface of the actuator.

15. The lighter as in claim 1, wherein the first portion is a finger actuation portion and the second portion is a body portion, and the actuator further including walls defining a channel, and said body portion further including a central member extending from the finger actuation portion, and the central member including two pins extending from a front surface and a rear surface of said central member, and at least two of the walls of the actuator defining bores for receiving the pins.

16. The lighter as in claim 1, wherein the first portion is a finger actuation portion and the second portion is a body portion, and the actuator further including walls defining a channel, and at least two of the walls of the actuator including pins, and said body portion further including a central member extending from the finger actuation portion, and the central member defining two bores in a front surface and a rear surface of said central member, the pins being received within the bores.

17. The lighter as in claim 1, wherein the first portion is a finger actuation portion and the second portion is a body portion, and the actuator further including walls defining a channel, and said body portion further including a central member extending from the finger actuation portion, and the central member defining a bore extending from a front surface to a rear surface of said central member, and at least two of the walls of the actuator defining bores, and the lighter further including a pin disposed through the latch member bore and the actuator bores.

18. The lighter as in claim 1, wherein the first portion is a finger actuation portion and the second portion is a body portion, and the actuator further including walls defining a channel, and at least two of the walls of the actuator including at least one pin, and said body portion further including a central member extending from the finger actuation portion, and the central member defining a notch extending from the free end, the pin being received within the notch.

19. The lighter as in claim 1, wherein the first portion is a finger actuation portion and the second portion is a body portion, and the actuator further including walls defining a channel, and said body portion further including a central member extending from the finger actuation portion, and the central member defining at least one bore therethrough, and at least one of the walls of the actuator defining a bore, and the lighter further including a pin disposed through the latch member bore and the actuator bore.

20. The lighter as in claim 19, wherein the pin is coupled to the latch member.

21. The lighter as in claim 19, wherein the pin is separate from the latch member and actuator.

22. The lighter of claim 1, wherein the ignition mechanism is operatively associated with the actuator.

23. The lighter of claim 22, wherein the ignition mechanism is coupled to the actuator.

24. The lighter of claim 1, wherein the ignition mechanism is a piezoelectric mechanism.

25. The lighter of claim 1, wherein the ignition mechanism further includes a longitudinal axis, and the movement of the actuator from the first position to the actuation position is along the longitudinal axis.

26. The lighter of claim 1, wherein the latch member is held in the operative position by the user's finger.

27. The lighter of claim 1, wherein the actuator is capable of being depressed at least once by a finger of the operator while the latch member is in an intermediate position.

28. A lighter comprising:

a housing having a fuel supply and a blocking surface;

a valve for supplying fuel from said fuel supply;

an actuator mounted for movement with respect to said housing;

an ignition mechanism for igniting the fuel;

a latch member having a first portion and a second portion having a free end; and a biasing element operatively associated with the latch member, the biasing element biasing and moving the latch member into a locked position whenever it is released by a user, wherein said latch member is pivotally coupled to said actuator such that in the locked position the free end of the latch member is aligned with the blocking surface and movement of the first portion in a first direction causes the free end to move in a second direction opposite to the first direction and causes the free end to become unaligned with the blocking surface which permits movement of said actuator from said first position to an actuation position, and the latch member is pivotal side-to-side.

29. The lighter of claim 28, wherein the latch member is separate from the actuator.

30. The lighter of claim 28, wherein the ignition mechanism further includes a longitudinal axis, and the movement of the actuator from the first position to the actuation position is along the longitudinal axis.

31. A lighter comprising:

a housing having a fuel supply and a blocking surface;

a valve for supplying fuel from said fuel supply;

an actuator mounted for movement with respect to said housing;

an ignition mechanism being operatively associated with the actuator, and movement of said actuator from a first position to an actuation position causing said ignition mechanism to ignite said fuel; and a latch member having a first portion and a second portion having a free end, wherein said latch member is pivotally coupled to said actuator, such that in a locked position the free end of the latch member is aligned with the blocking surface, wherein movement of the first portion in a first direction causes the free end to move in a second direction opposite to the first direction and causes the free end to become unaligned with the blocking surface which permits movement of said actuator from said first position to said actuation position to actuate said ignition mechanism to ignite said fuel, and the latch member is pivotal side-to-side.

32. The lighter of claim 31, wherein the latch member is coupled to the actuator.

33. The lighter of claim 31, wherein the ignition mechanism further includes a longitudinal axis, and the movement of the actuator from the first position to the actuation position is along the longitudinal axis.

34. The lighter of claim 33, further including a biasing element operatively associated with the latch member, wherein the biasing element biases and moves the latch member into the inoperative position whenever the latch member is released by a user.

* * * * *